United States Patent [19]

Mueller

[11] Patent Number: 5,040,437

[45] Date of Patent: Aug. 20, 1991

[54] CORKED BOTTLE OPENER

[76] Inventor: John H. Mueller, 173 W. 25th Ave., Oshkosh, Wis. 54901

[21] Appl. No.: 580,960

[22] Filed: Sep. 11, 1990

[51] Int. Cl.[5] ..... B67B 7/02

[52] U.S. Cl. ..... 81/3.2; 81/3.32; 81/3.39

[58] Field of Search ..... 81/3.2, 3.25, 3.31, 81/3.32, 3.36, 3.29, 3.37, 3.39

[56] References Cited

U.S. PATENT DOCUMENTS

| | | | |
|---|---|---|---|
| 3,800,345 | 4/1974 | Feliz | 81/3.37 |
| 4,295,392 | 10/1981 | Peck | 81/3.32 |
| 4,422,355 | 12/1983 | Burns, Jr. | 81/3.36 |
| 4,519,277 | 5/1985 | Raab | 81/3.55 |
| 4,766,780 | 8/1988 | Sechen | 81/3.2 |
| 4,875,394 | 10/1989 | Crudgington | 81/3.36 |

FOREIGN PATENT DOCUMENTS

| | | | |
|---|---|---|---|
| 1543 | of 1864 | United Kingdom | 81/3.36 |

*Primary Examiner*—Roscoe V. Parker
*Attorney, Agent, or Firm*—R. Jonathan Peters

[57] ABSTRACT

A corked bottle opener comprising a stationary shaft and a rotatable stem extending longitudinally from the shaft and mounted for axial movement relative thereto. An adjustably mounted retainer extends from the shaft and engages the neck of the bottle. A jaw member extends from the stem, but is held against rotation, engages the stopper. An actuator rotates the stem to move it axially and thereby raise the jaw member so as to remove the cork.

9 Claims, 6 Drawing Sheets

CORKED BOTTLE OPENER

This application is a Continuation in Part application of Ser. No. 385,658, filed on July 25, 1989, now abandoned.

FIELD OF INVENTION AND BACKGROUND

This invention relates to a bottle opener. In its more specific aspect, this invention relates to a device or mechanism for removing a cork or stopper from a bottle such as a champagne bottle.

Bottles of champagne and sparkling wine are corked with a friction fit stopper, which today is customarily a plastic material. An extremely tight and secure fit or retention is necessary to prevent the pressurized gas from pushing out the stopper. Consequently, at the time of serving, one must exert considerable manual force and pulling, and even for a strong person, it is extremely difficult to remove the stopper by hand. Also, because of the internal pressure, caution must be exercised to prevent the cork from flying and possibly injuring someone nearby or causing property damage.

Aside from the long standing corkscrew, which is not at all useful for the new plastic corks in wide use today, a number of mechanical devices have been proposed for removing the stopper. Typically, the plastic stopper in common use today is of a generally cylindrical shape having smooth or ribbed side walls, and a downwardly facing annular shoulder. Many mechanical devices shown in the prior art for removing the plastic stopper utilize gripping jaws and a screw action, and some devices disclose means for positioning the device on the bottle for accurate gripping and removing of the stopper. For example, the corked bottle opener described in U.S. Pat. No. 4,295,392 to Peck has a base member for positioning the bottle, a retaining bracket to support the neck of the bottle, and a hinged corkscrew bracket. This device would not be useful for the typical plastic stopper in wide use today.

British Patent 1543, issued on June 21, 1864, though obviously designed for the conventional cork and long before plastic stoppers, might theoretically have utility for todays plastic stopper. According to the teachings of the British patent, there are two spaced apart jaws, lower jaw d that engages the neck of the bottle and upper jaw c that engages the shoulder of the cork. These jaws are forced apart (move in opposite directions) as the screw h is turned by handle f. This means that jaw d is forced downwardly onto the bottle, and jaw c is forced upwardly. This device presents several disadvantages. To operate the British opener, three hands are required. One hand is necessary to turn the screw; a second hand is reguired to hold the opener and bottle; and a third hand is required to hold the cork. If one holds the bottle only, as the handle is turned, the whole opener would rotate, and therefore it would not be possible to remove the stopper. Hence, it is necessary to hold the opener and bottle together. Further, the opener is of a fixed length, and therefore can be utilized with a bottle having a neck length that is within an average range because the jaws operate within a narrow range. Thus, the opener cannot fit a bottle with a very short neck, because the adjustment of the jaws is limited to the length of the screw. Similarly, if the bottle has a very long neck, the screw length would not be sufficient for the jaws to extend between the two positions. Also, the adjustable stopper remover of the jaw member shown in FIG. 8 of the British Patent requires two screws to be turned in opposite directions (one screw in front and one in back, with a vertical center-line shaft), which makes the operation of the opener cumbersome.

U.S. Pat. No. 3,800,345 to Feliz discloses an integral wire cutter and cork remover. The Feliz mechanism includes a yoke for engaging the bottle neck flange, and a clamp for gripping the cork. The clamp is affixed to a telescopically slidable column which is actuated for longitudinal movement by a screw. The bottle opener disclosed in U.S. Pat. No. 4,422,355 to Burns also utilizes a clamping means for gripping the cork, and an axial turning movement is applied to the clamp by a screw to lift and remove and stopper.

The devices shown in the prior art, however, appear to have a complicated structure, are cumbersome to operate, or lack positioning and support means.

This invention, therefore, has as its primary purpose to provide a cork extractor that removes the cork from the bottle by a precision controlled, safe and easy means.

It is a further object of the invention to overcome the limitations of the prior art.

It is yet another object of the invention to provide a mechanism which is economical and of a relatively simple structure.

SUMMARY OF THE INVENTION

The present invention provides a mechanism or device for removing the cork or stopper from a bottle, such as a bottle of champagne or sparkling wine. It should be understood that the terms "cork" and "stopper" as used herein and in the appended claims are used as synonymous terms. The device of my invention allows for the upright positioning, bracing and cork extraction in quick, simple maneuvers. The cork typically is of a plastic material, such as nylon or the like, having ribbed side walls, a downwardly facing shoulder, and a frusto-convex head. Broadly, the opener device comprises a base or platform, desirably having a recessed portion for accommodating the bottom of the bottle and helps to retain the bottle from slipping or sliding such as might occur if placed on a smooth surface. The base is of sufficient size and weight to accommodate the bottle and to support the mechanical features of the device. A vertically positioned shaft or post is fixedly mounted substantially normal to the base, and generally to one side or off center. A retainer means, preferably a slotted ring, is adjustably mounted onto the shaft and extends laterally therefrom. The retainer engages at least a portion of the neck of the bottle, and the position of the retainer may be varied along the shaft depending on the size of the bottle and the shape of the neck. The retaining means helps in bracing the bottle, and this retainer in combination with the recess in the base hold the bottle securely against sliding out from under the person opening the bottle. A rotatable stem extends longitudinally from the shaft and is mounted for axial turning movement relative to the shaft.

A bracket is connected to the stem and extends laterally therefrom. A stop means secures the bracket against rotation upon rotation of the stem, but the bracket moves vertically upon axial translation of the stem. At its opposite end from the connection to the stem, the bracket terminates with a jaw assembly for engaging at least a portion of the shoulder of the stopper. The jaw includes suitable means for adjusting its opening and to urge the jaw into tight engagement with the shoulder of the cork. Actuating means, which may be either a mechanical means or motor means, applies a rotating movement to the stem to move the stem axially relative to the shaft, and thereby move the bracket and integral jaw assembly. When the jaw means is gripping the shoulder of the stopper, movement of the bracket raises the stopper from a closing position.

DETAILED DESCRIPTION OF THE INVENTION AND PREFERRED EMBODIMENTS

Figure 1:
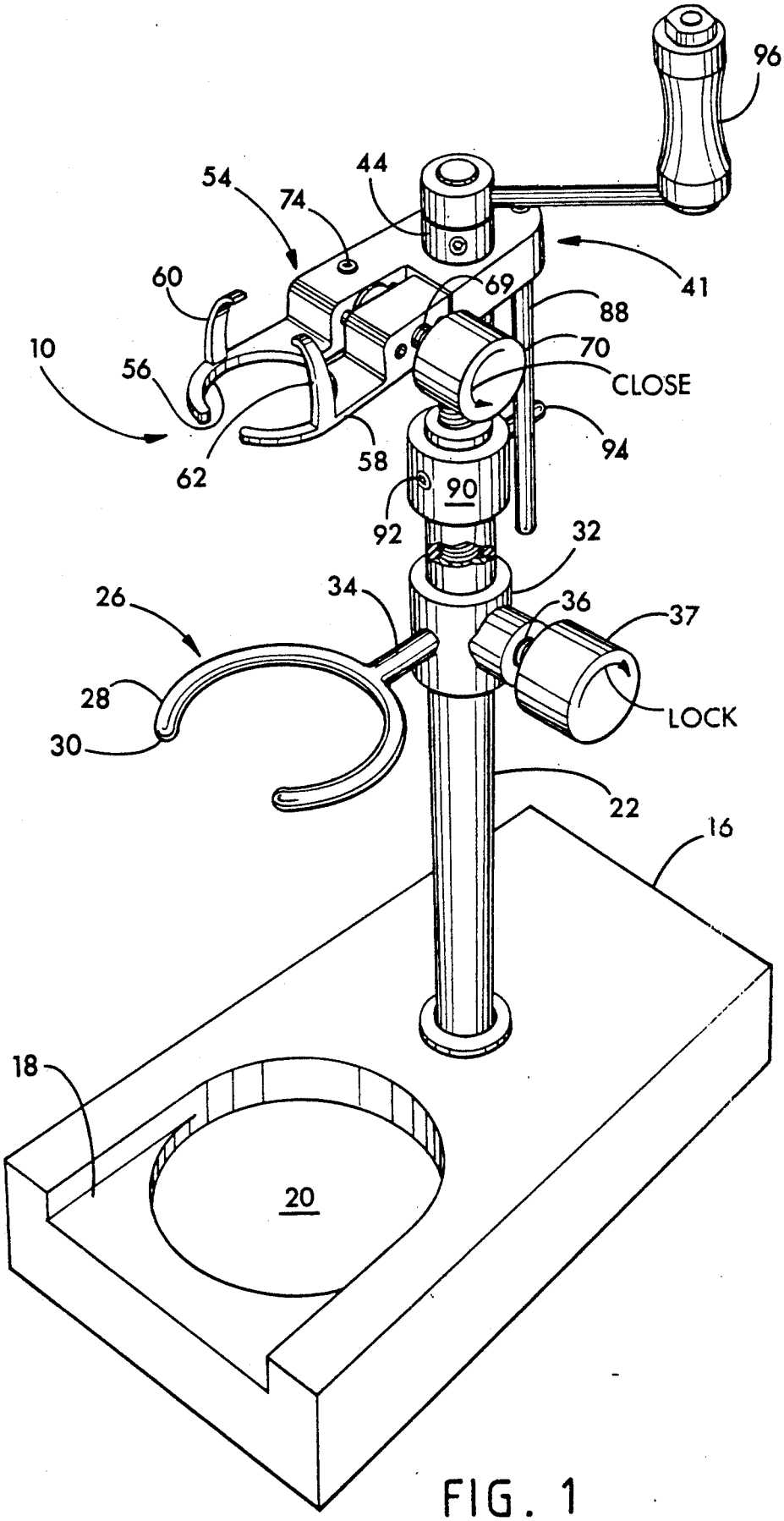
FIG. 1 is a perspective view of the bottle opener embodying the invention.
Figure 2:
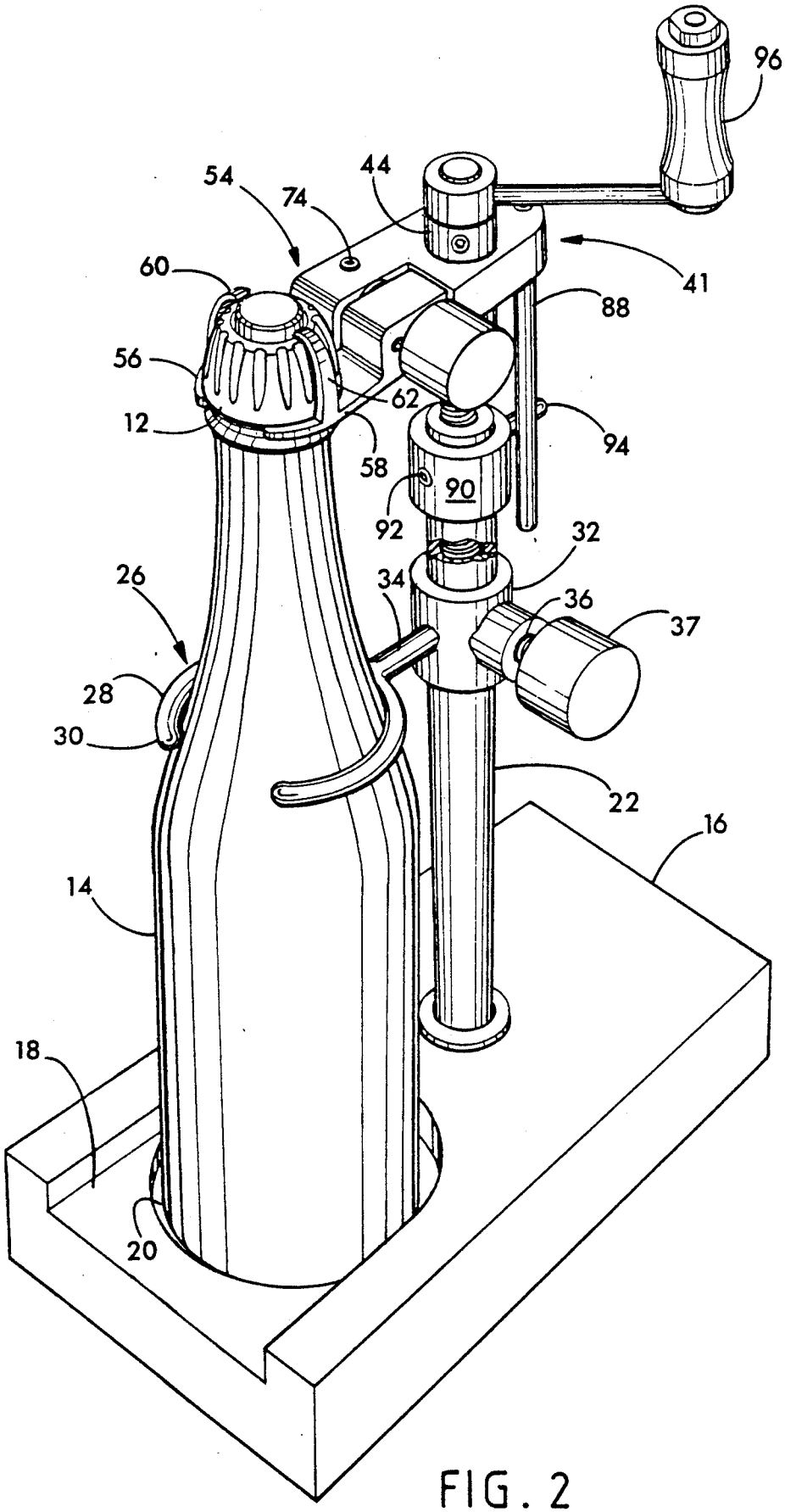
FIG. 2 is a view similar to FIG. 1 showing a typical bottle of champagne in place.
Figure 3:
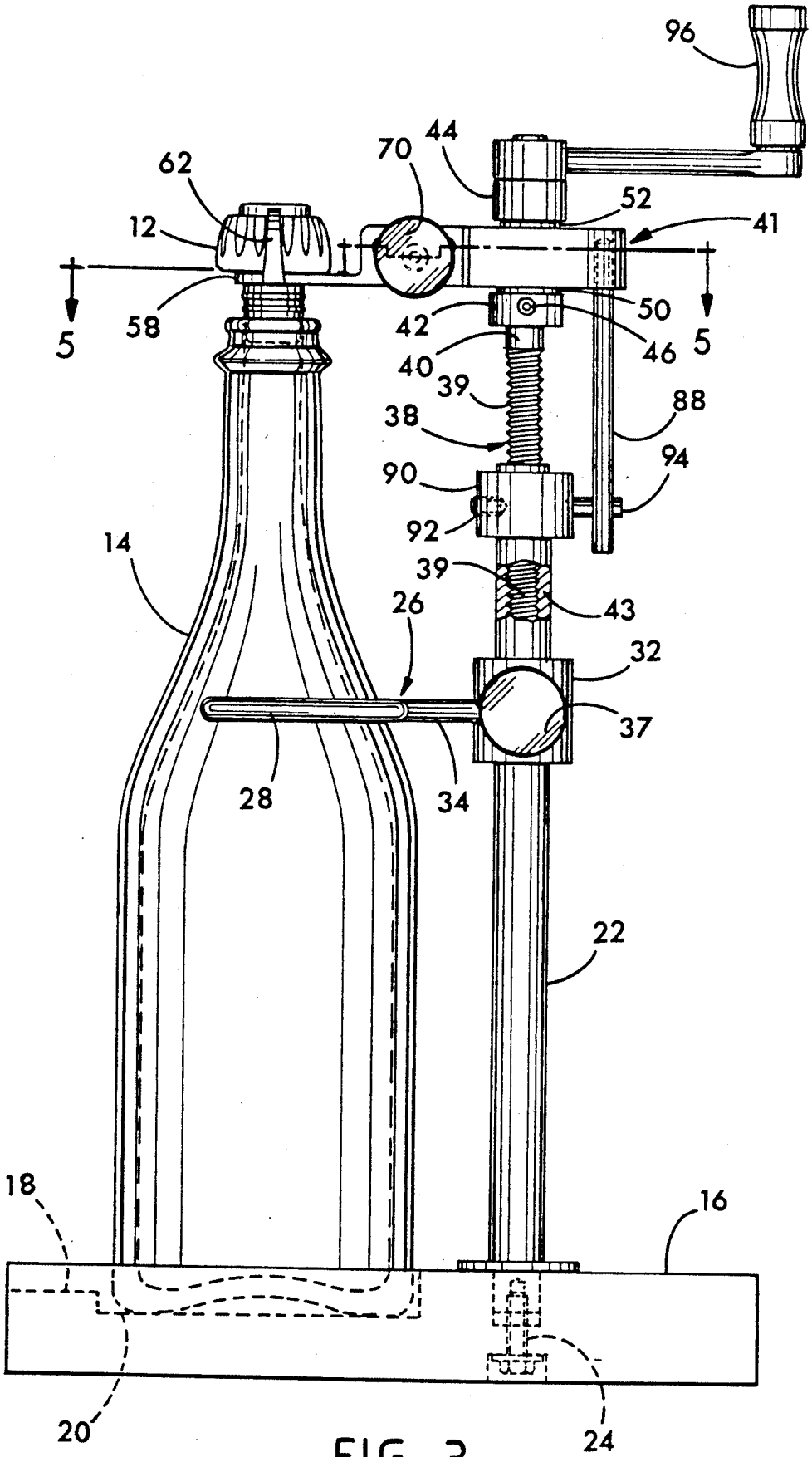
FIG. 3 is a side elevational view of the device (with a portion broken away to show otherwise hidden structural features) illustrating its engagement with a typical champagne bottle showing the stopper partially removed from the throat of the bottle.
Figure 4:
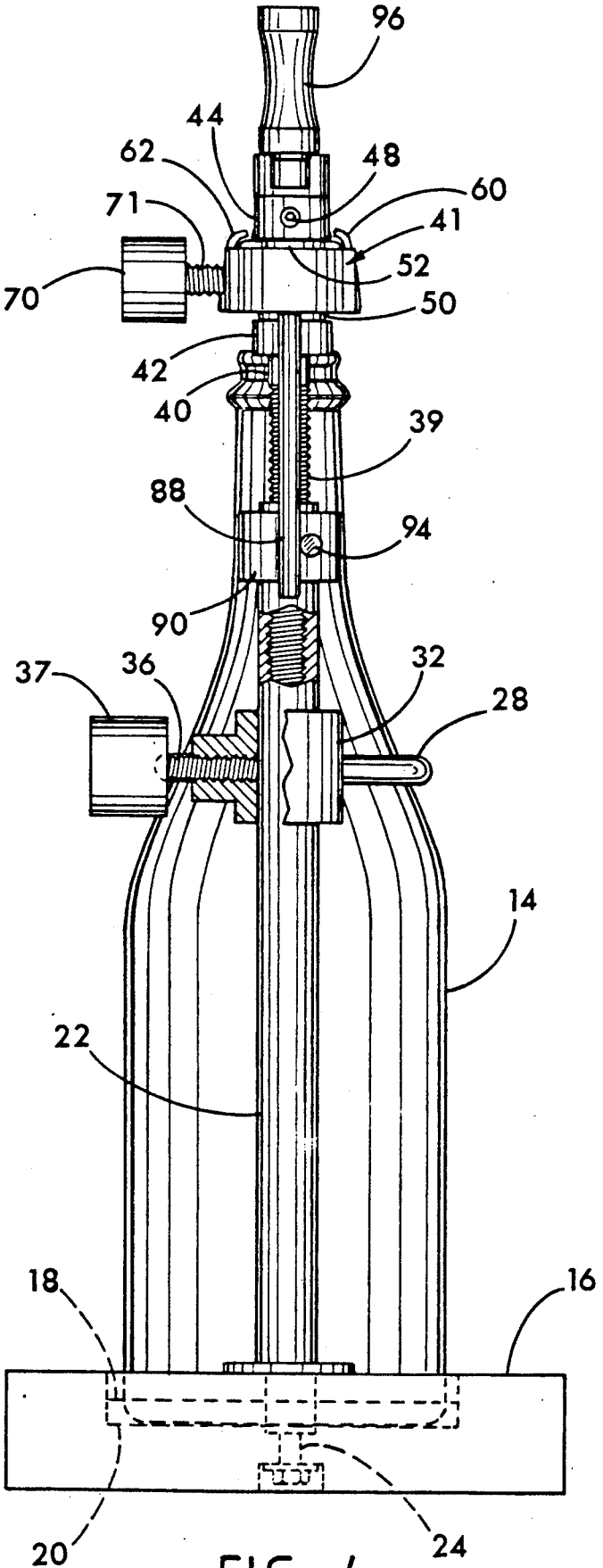
FIG. 4 is a rear elevational view of the device of FIG. 3.

Referring to the drawings wherein like reference numerals designate similar parts throughout, there is shown as an embodiment of my invention (see in particular FIGS. 1 through 4) an opening device designated in general by the numeral 10, which is in operative position (see FIG. 2) for removing the cork or stopper 12 from the bottle 14 of champagne. The embodiment illustrated has a rectangular base 16 of any desirable material such as wood, metal or plastic, but should be of sufficient size and weight to adequately support the mechanism. Base 16 preferably is provided with a niche, socket or the like, 18 which is further recessed at 20 (as shown in FIGS. 3 and 4 by broken lines for purposes of clarity), and is of sufficient depth and contour to accommodate the bottom of the bottle 14 and thereby locate the bottle in its correct place relative to the jaw opener, described below, and to help retain the bottle in position and against slipping or sliding. A non-skid pad, not shown, may be provided in recess 20 to aid against slipping and to cushion the bottle on the base.

A stationary shaft 22 is mounted substantially normal to the base 16. The shaft 22 is secured in place to the base by any desirable means such as by a threaded attaching bolt 24 or the like (shown by broken lines in FIGS. 3 and .4). A separate retainer means indicated generally: at 26 is adjustably mounted for vertical and horizontal pivotal movement on shaft 22 above base 16. The position of retainer means 26 may be varied depending on the height of the bottle, and is adapted to receive the neck of the bottle. In the preferred embodiment, retainer means 26 comprises a ring 28 with an opening or slot 30, and is concentrically arranged with recess 20 along an imaginary longitudinal axis. The ring is attached to a collar 32 by arm 34, and collar 32 is slidably mounted for vertical movement on shaft 22 and also for pivotal horizontal movement. The collar 32 is secured in place by set screw 36, which is provided with knob 37 to facilitate turning. In this manner, the ring or retainer means may be adjusted in height to accommodate the size of the bottle, and when resting on the neck of the bottle, collar 32 is secured by set screw 36 so that ring 28 holds the bottle in place during operation of the mechanism. Where desired, the ring may be provided with a soft material such as plastic or rubber cover (not shown) so as to cushion the ring on the bottle and thereby minimize any damage or breakage.

Stem 38, having a lower threaded portion 39 and upper shank portion 40 (see FIG. 3), extends longitudinally from the shaft 22. At least the upper portion of shaft 22 is internally threaded at 43 (see FIGS. 3 and 7) to engage with the externally threaded portion of the stem, thereby permitting axial translation of the stem upon rotation relative to the affixed shaft.

Figure 5:
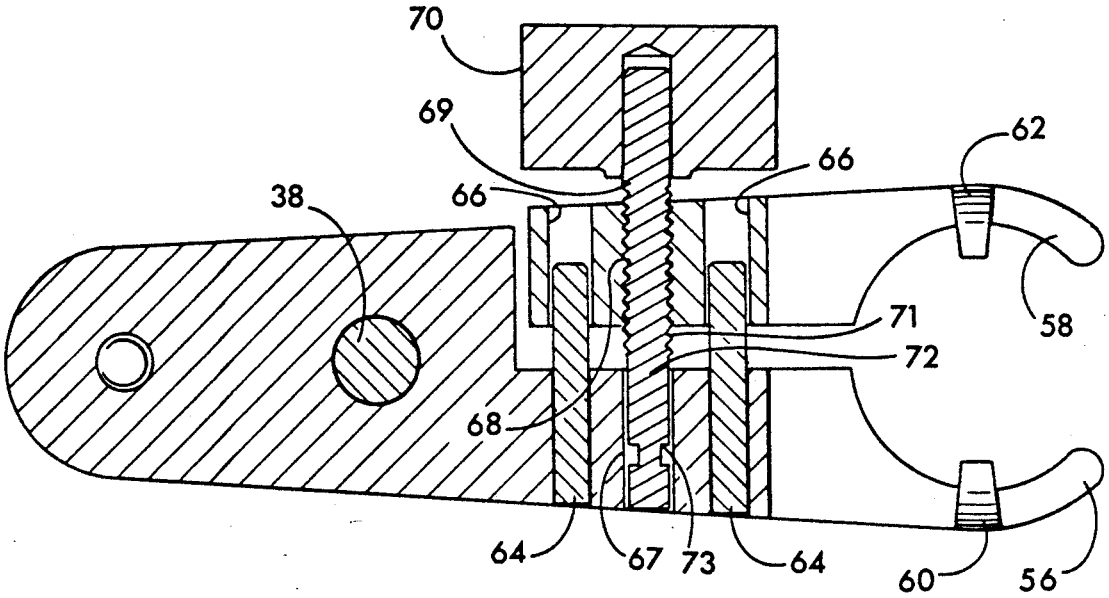
FIG. 5 is a sectional view taken on line 5—5 of FIG. 3 illustrating the details of the jaw assembly.

A bracket 41 extends laterally from the upper end of the stem 38. The bracket is mounted or connected to the stem between a pair of oppositely disposed boss members 42 and 44, which are secured or locked to the stem by set screws 46 and 48. Anti-friction washers 50 and 52, such as Teflon washers, may be provided to form the seat for the boss members. At the opposite end of the bracket, that is outwardly from the mounting, there is provided an adjustable jaw assembly, indicated generally by the numeral 54, having oppositely disposed termini 56 and 58 being generally arcuate in cross-section to conform to the contour of the cork and to grip or engage the shoulder of the cork for removal. In the preferred embodiment of the invention, the termini of the jaw include a stationary terminus or arm 56 and a movable or radially adjustable terminus or arm 58. Each of the termini is provided with an upwardly and inwardly directed flange member 60 and 62, which are generally arcuate or curved concavely to engage the head portion of the stopper. In a preferred embodiment, and as best seen in FIG. 5, a plurality of spaced apart connecting pins 64, affixed to arm 56, extend laterally from the vertical facing of this stationary arm. The vertical facing of movable arm 58 is provided with complementary apertures 66 which are slightly larger in diameter than that of the pins to allow for the arm 58 to move or slide horizontally upon the horizontal movement of arm 58. Stationary arm 56 is provided with a horizontally disposed aperture 67, and movable arm 58 is provided with an internally threaded apertures 68, said apertures 67 an 68 being aligned for engaging locking bolt 69 having a turning knob 70. Locking bolt 69 has a threaded section 71 for threadedly engaging threaded aperture 68, and at its opposite end a non-threaded or shank section 72 having an annular groove 73. The bolt 69 threadedly engages threaded aperture 68 and extends into aperture 67, which is of slightly largely diameter than shank 72. Set screw 74 rests in annular groove 73, so that as locking bolt 69 is turned, the bolt is free to rotate but cannot move axially. In order to tighten the jaw assembly so as to grip the cork, locking bolt 69 is turned to axially translate movable arm 58, which moves horizontally along pins 64. Arm 58 is also supported and stabilized by pins 64. Because the bolt rotates but does not move axially by reason of being held in place by set screw 74, and because the arm 58 moves outwardly until it abuts turning knob 70, the jaw will not become disassembled.

Figure 6:
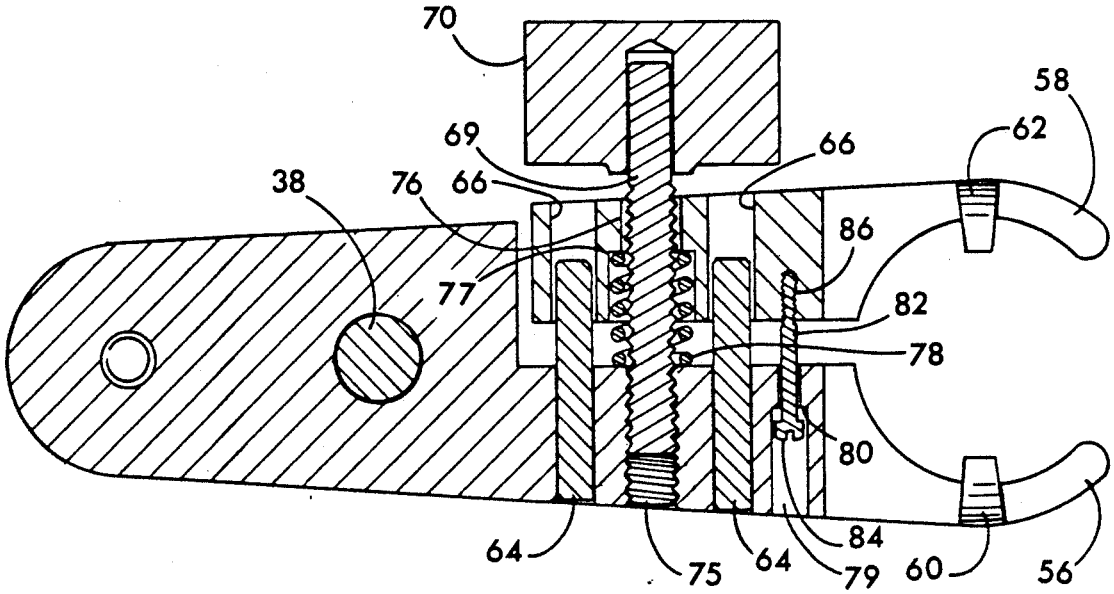
FIG. 6 is a sectional view similar to FIG. 5 but showing an alternative embodiment of the jaw assembly.

In an alternative embodiment for the jaw assembly shown in FIG. 6, arm 56 is provided with an internally threaded aperture 75, which is aligned with bore 76, having shoulder 77, in arm 56. Locking bolt 69 extends through bore 76 and into threaded engagement with threaded aperture 75. Surrounding bolt 69, and abutting the vertical facing of arm 56 at one end, is coil spring 78. The opposite end of the coil spring abuts shoulder 77 of bore 76. Coil spring 78 biases the arm 58 to an open position relative to the stationary arm 56. Thus, when the knob is turned in an opening direction, the arm 58 is pushed outwardly relative to arm 56 by spring 78 to open the jaw thereby engaging the shoulder of the stopper. Stationary arm 56 is also provided with bore 79 having shoulder 80. A stationary screw 82, having head 84, extends through bore 79 and is affixed at its opposite end 86 to movable arm 58. As arm 58 moves in an opening direction, screw 82 moves horizontally until head 84 abuts shoulder 80, thereby limiting or determining the opening distance of the jaw and preventing the jaw from becoming disassembled.

The bracket 41 is held against rotation by a suitable stop member but not against axial translation upon axial translation of stem 38. In a preferred embodiment, extension or detent 88 extends downwardly from the bracket 41, preferably to the rearward side of the stem 38 and shaft 22. Also, shaft 22 is provided with a collar 90, fixed to shaft 22 by set screw 92, and stop means 94 projects horizontally from the collar. Thus, when the stem is rotated for axial translation for removing the cork (normally a counter-clockwise direction) the detent 88 engages stop 94 and thereby holds the bracket against rotation but not against axial translation.

The upper end or shank 40 of stem 38 is provided with a suitable turning crank or wheel 96. In this manner, when the crank is turned in counter-clockwise direction, the stem 38 rotates moving upwardly relative to the shaft 22, thereby moving the bracket with the jaw assembly in an upward direction.

Operation of the opening device of my invention, particularly the preferred embodiment as shown in FIGS. 1 through 5, follows a relatively simple procedure. First, one must remove all safety means placed over the cork by the bottling company. For example, the bottle of champagne or the like may have placed over the cork a metal foil, a cap, and most typically a safety wire or binding wire, which wire is relatively thin gauge, and any of these items or means may be easily removed by hand. The bottle is then placed in the recess 20 of base 16 as the position of the retainer ring 28 is adjusted vertically and pivotal horizontally to be aligned with and fit the neck of the bottle. Set screw 36 is then tightened to hold the ring in place. The bracket, with its jaw assembly wide open, is then adjusted to the level of the cork by turning the crank s that stationary arm 56 engages the shoulder of the stopper. Turning knob 70 is turned to bring movable arm 58 into engagement with the stopper shoulder. The cork is now firmly engaged not only at the 1 shoulder by the two arms of the jaw but at the head by the flange members 60 and 62. As the crank 96 is rotated in a counter-clockwise direction, the bracket with its integrally formed jaw will raise the stopper out of the mouth of the bottle. Because the stopper is held securely by the jaw assembly, the stopper cannot suddenly burst or explode from the mouth as it is loosened, which frequently occurs when the cork is removed by hand. After the bottom of the stopper is above the mouth, the bracket 41 is then swung in a clockwise direction so as to be free of the bottle, retainer ring 28 is raised, and the bottle of champagne is removed from the base and ready for serving.

Figure 7:
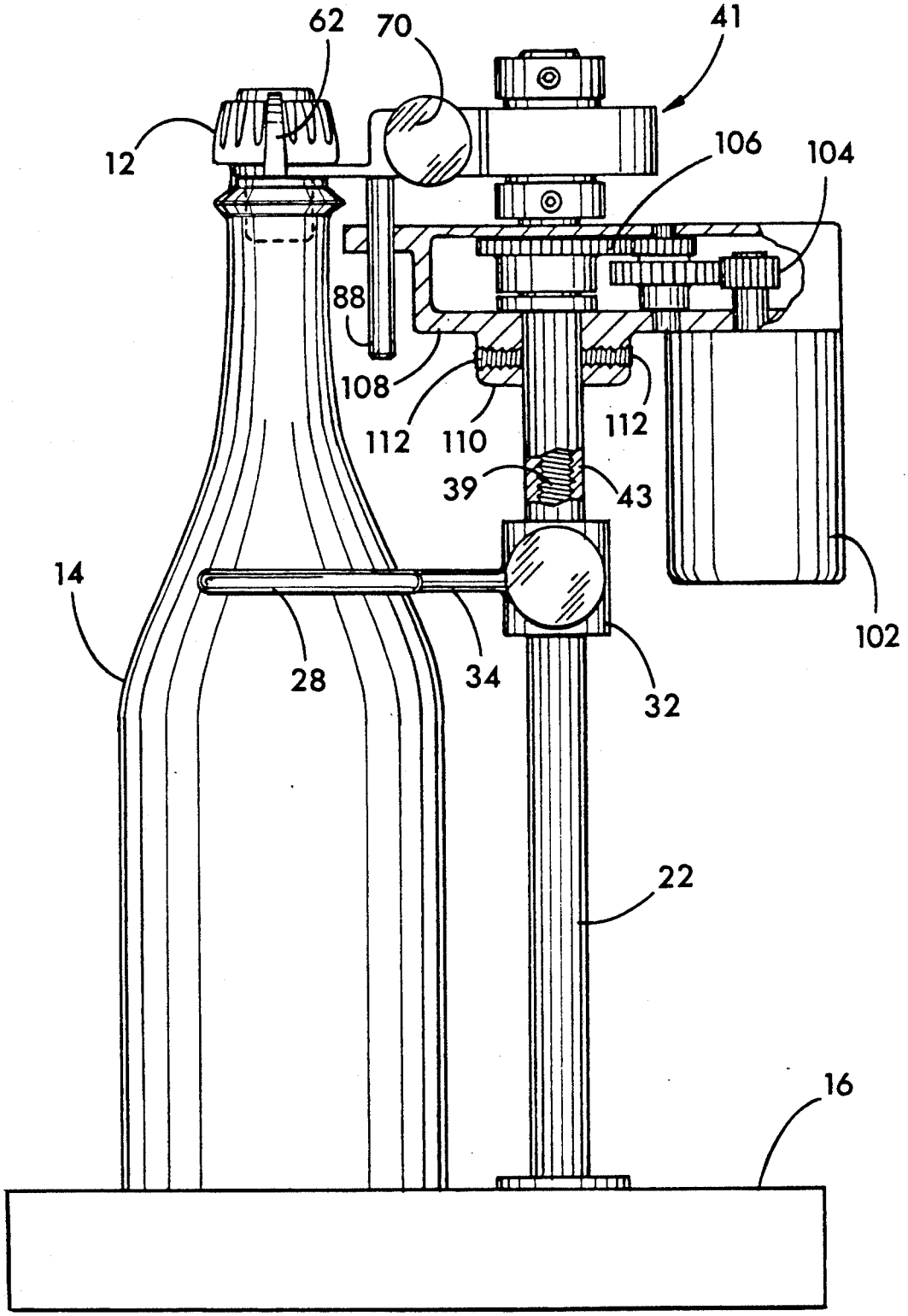
FIG. 7 is a side elevational view (with a portion broken away to show otherwise hidden structural features) showing an alternative embodiment of the opening mechanism of the invention.

FIG. 7 shows a motor operated mechanism as an alternative embodiment of the invention. In accordance with this embodiment, the detent 88 and stop 94 are forward of the mounting of bracket 41 on stem 38. Motor unit 102 supplied with energy from any suitable source (not shown) drives a worm gear 104 meshing with splined sleeve 106 for rotating the same. Member 108 for housing the gear and sleeve is mounted onto the shaft by collar 110 having set screws 112. Stem 38 is integrated with the splined sleeve. Thus, rotation of the splined sleeve by the gear rotates the stem for movement of the bracket to raise the cork.

Having thus described the invention generally and in terms of specific embodiments thereof, 1 claim:

1. A mechanism for extracting a stopper from a bottle, said stopper having a head and a downwardly facing annular shoulder, comprising:

a. a base, b. a stationary shaft fixedly mounted substantially normal to said base, c. retaining means adjustably mounted on said shaft for vertical and horizontal pivotal movement and extending laterally therefrom for engaging at least a portion of the neck of said bottle, including means for securing said retaining means in adjustably mounted position, d. a rotatable stem extending longitudinally from said shaft and mounted for axial movement relative thereto, e. a bracket connected to and extending laterally from said stem for vertical movement upon axial movement of said stem, said bracket terminating at the opposed end from said connection with a jaw member having a stationary arm and a radially adjustable arm for engaging at least a portion of said shoulder of said stopper, f. means for securing said bracket against rotation upon rotation of said stem, and g. actuating-means for applying a rotating movement to said stem to move said stem axially relative to said shaft and thereby move said bracket and jaw member relative to said bottle to remove said stopper.

2. A mechanism according to claim 1 wherein said base includes an integrally formed retainer means for accommodating the bottom of said bottle and for retaining said bottle against lateral movement on said base.

3. A mechanism according to claim 1 wherein said base is provided with a recessed portion for accommodating the base of the bottle for retaining said bottle against lateral movement on said base.

4. A mechanism according to claim wherein said shaft includes an axial bore having an internally threaded section, and said stem having an externally threaded section for engagement with said internally threaded section of said shaft and moves axially upon rotation effected by said actuating means.

5. A mechanism according to any of claims 1, 2, 3 or 4 wherein said jaw member is provided with an upwardly and inwardly flange member for engaging the head portion of said stopper.

6. A mechanism according to any of claims 1, 2, 3 or 4 including means for radially adjusting said jaw to an open and closed position to urge said jaw into engagement with said stopper.

7. A mechanism according to any of claims 1, 2, 3 or 4 wherein said actuating means includes a handle for rotating said stem to effect said axial movement.

8. A mechanism according to any of claims 1, 2, 3 or 4 wherein said actuating means comprises a motor for rotating said stem to effect said axial movement.

9. A mechanism for extracting a stopper from a bottle, said stopper having a head and a downwardly facing annular shoulder, comprising:

a. a base having a recessed portion for accommodating the bottom of the bottle for retaining said bottle against lateral movement on said base b. a stationary shaft fixedly mounted substantially normal to said base, said shaft including an axial bore having an internally threaded section, c. retaining means adjustably mounted on said shaft for vertical and horizontal pivotal movement and extending laterally therefrom for engaging at least a portion of the neck of said bottle, including means for securing said retaining means in adjustably mounted position, d. a rotatable stem having an externally threaded section for longitudinal engagement with said internally threaded section of said shaft, and moves axially upon rotation thereof, e. a bracket means connected to and extending laterally from said stem for vertical movement upon rotation of said stem, said bracket means terminating at the opposed end from said connection with a jaw member having a stationary arm and a radially adjustable arm, said jaw member further having upwardly and inwardly flange members for engagement with said stopper including said shoulder when urged into a closing position, f. means for securing said bracket against rotation upon rotation of said stem, and g. actuating means for applying a rotating movement to said stem to move said stem axially relative to said shaft and thereby move said bracket and jaw member relative to said bottle to remove said stopper.

* * * * *